US008806706B2

(12) United States Patent
Bosses

(10) Patent No.: US 8,806,706 B2
(45) Date of Patent: Aug. 19, 2014

(54) FILTER BAG INDICATOR AND LOCK-OUT SAFETY SYSTEM

(75) Inventor: Mark D. Bosses, Boca Raton, FL (US)

(73) Assignee: Zenith Technologies, LLC, Fort Lauderdale, FL (US)

( * ) Notice: Subject to any disclaimer, the term of this patent is extended or adjusted under 35 U.S.C. 154(b) by 733 days.

(21) Appl. No.: 13/074,846

(22) Filed: Mar. 29, 2011

(65) Prior Publication Data

US 2012/0247384 A1 Oct. 4, 2012

(51) Int. Cl.
*A47L 9/14* (2006.01)

(52) U.S. Cl.
USPC ..... 15/347; 15/350; 15/DIG. 8; 55/378

(58) Field of Classification Search
USPC ..... 15/347, 350, 351, DIG. 8; 55/378
IPC ..... A47L 9/14
See application file for complete search history.

(56) References Cited

U.S. PATENT DOCUMENTS 5,028,245 A 7/1991 Stein et al.
5,755,009 A * 5/1998 Stephens et al. ..... 15/347
5,766,283 A * 6/1998 Bumb et al. ..... 55/367

* cited by examiner

*Primary Examiner* — David Redding
(74) *Attorney, Agent, or Firm* — Roylance, Abrams, Berdo & Goodman, L.L.P.

(57) ABSTRACT

The present invention provides a lock-out system and a lock-out apparatus for a vacuum cleaner having a closeable shell for a filter bag. The system includes a filter bag collar mount and a locking mechanism for a filter bag movably connected to the filter bag collar mount. The locking mechanism is able to be in one of an engaged position or in a disengaged position relative to the filter bag mount. Also, the locking mechanism in the disengaged position prevents the closeable shell from closing.

20 Claims, 6 Drawing Sheets

FILTER BAG INDICATOR AND LOCK-OUT SAFETY SYSTEM

FIELD OF THE INVENTION

The present invention relates to a filter bag indicator and lock-out safety system for a vacuum cleaner.

BACKGROUND OF THE INVENTION

The bag is generally well known in the art. However, a filter bag indicator and lock-out safety system and apparatus as described in the present invention is previously unknown in the prior art.

SUMMARY OF THE INVENTION

The present invention provides a filter bag indicator and lock-out safety system for a vacuum cleaner.

Flow-through motor-style vacuum cleaner systems generally use an outer shell. The outer shell may be a partly porous bag, since the air flow is being pushed into the filter bag. The filter bag is usually a disposable inner bag. Typically the flow-through motor-style vacuum cleaner uses a porous outer bag made of woven or nonwoven fabric, or a combination of the two. In any of these constructions, the outer bag is closeable and usually employs a zipper or other fastening means to gain access to the inner bag for removal and replacement. The user of this system may dispose of a full or used inner filter bag, which is the primary filter, and forget to replace it with a new inner bag. In such an event, the vacuum cleaner may still operate, but it will spew dust and debris into the outer bag and perhaps the ambient environment (depending on the quality of the outer bag), thus making a terrible mess and potentially harming the outer bag or the vacuum cleaner.

Locking mechanisms for filter bags are generally known in the art. U.S. Pat. No. 5,028,245 to Stein et al. discloses a mechanism for confirming operation of a vacuum cleaner with the proper placement of a filter bag. However, that invention requires that the filter bag is placed on a separate part from the locking mechanism. Also, that invention requires a cam-and-shaft mechanism which requires specialized parts that are hard or impossible to replace or repair. Moreover, in that invention the only indication that a filter bag is not in place occurs when the closing mechanism is operated and fails. Thus, a user of that invention may discover the issue and have to take unnecessary time and effort to get the missing bag. Among the improvements in the present invention is that there is a visual cue outside the outer shell which may be perceived from a distance that a bag is missing. Thus, the present invention provides an important warning to a user so that the user may save time and effort during installation of a filter bag.

With the present invention, the user cannot close the outer bag unless the locking mechanism is in the down or engaged position. The locking mechanism provides a readily visible visual cue to a user that the filter bag is not in place. Essentially, a portion of the locking mechanism (when in the up and disengaged position) will protrude from the top of the outer shell (or outer bag) so it cannot be zipped or otherwise closed. This protruding portion will promptly alert the user that a filter bag is needed, and thus prevent the user from operating the vacuum cleaner without a properly installed filter bag.

In addition, the present invention provides one or more tabs on the locking mechanism that prevent the locking mechanism from being pushed into the down or engaged position unless a filter bag collar is properly seated in place. Thus, the system also helps prevent a user from closing the outer shell (e.g., zipper) without a filter bag being properly installed.

BRIEF DESCRIPTION OF THE DRAWINGS

A more complete understanding of the present invention, and the attendant advantages and features thereof, will be more readily understood by reference to the following detailed description when considered in conjunction with the accompanying drawings, wherein like designations refer to like elements, and wherein.

DETAILED DESCRIPTION OF THE INVENTION

Figure 1:
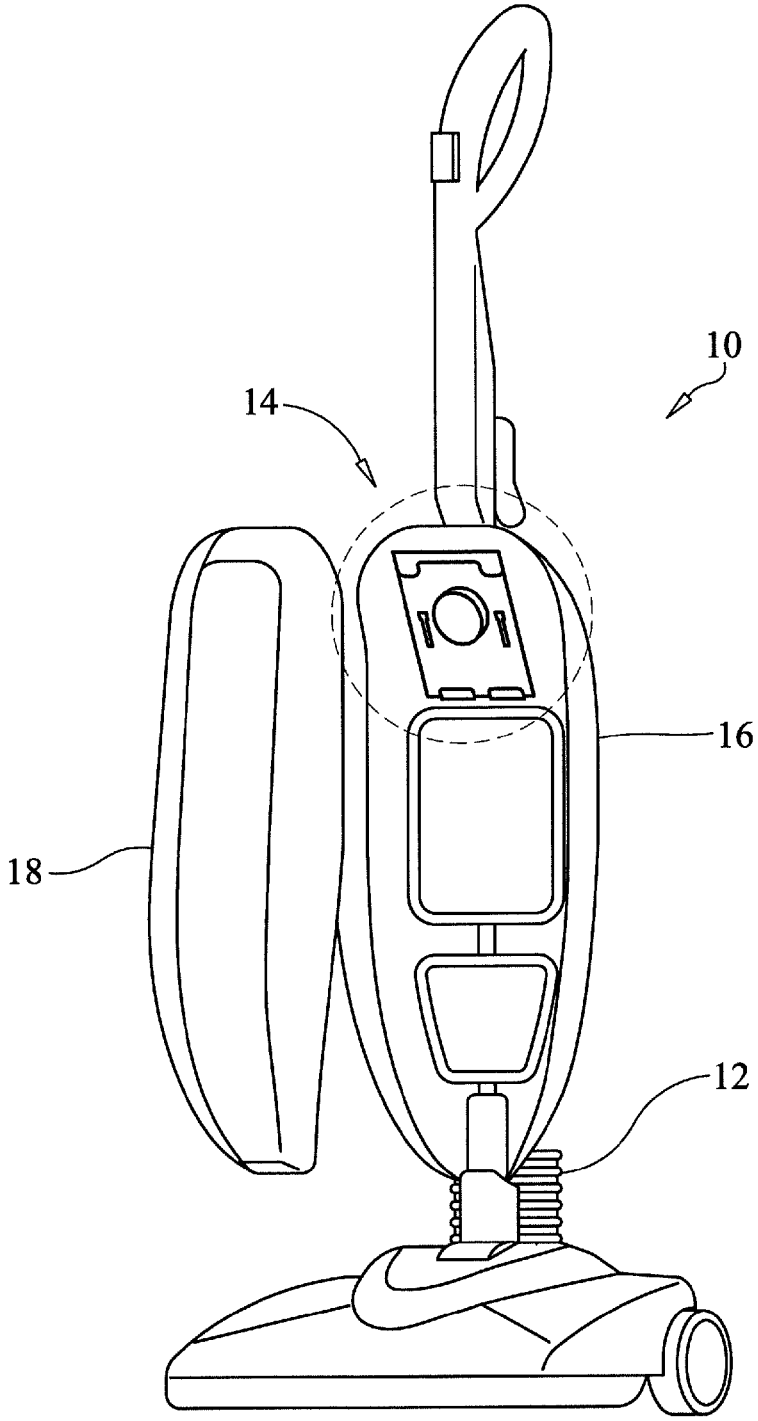
FIG. 1 is an illustration of a perspective view of an embodiment of a vacuum cleaner in accordance with the present invention.

FIG. 1 illustrates a filter bag indicator and lock-out safety apparatus 10 according to an exemplary embodiment of the invention. The apparatus 10 is located on a vacuum cleaner 12 having an enclosable outer shell 14. The outer shell has an inner portion 16 and an outer portion 18 that is encloseable with the inner portion 16 by a zipper (not shown) or an equivalent means for enclosing the outer shell known in the art. The outer shell 14 may be a porous outer bag made of woven or nonwoven fabric, or a combination of the two.

Figure 2:
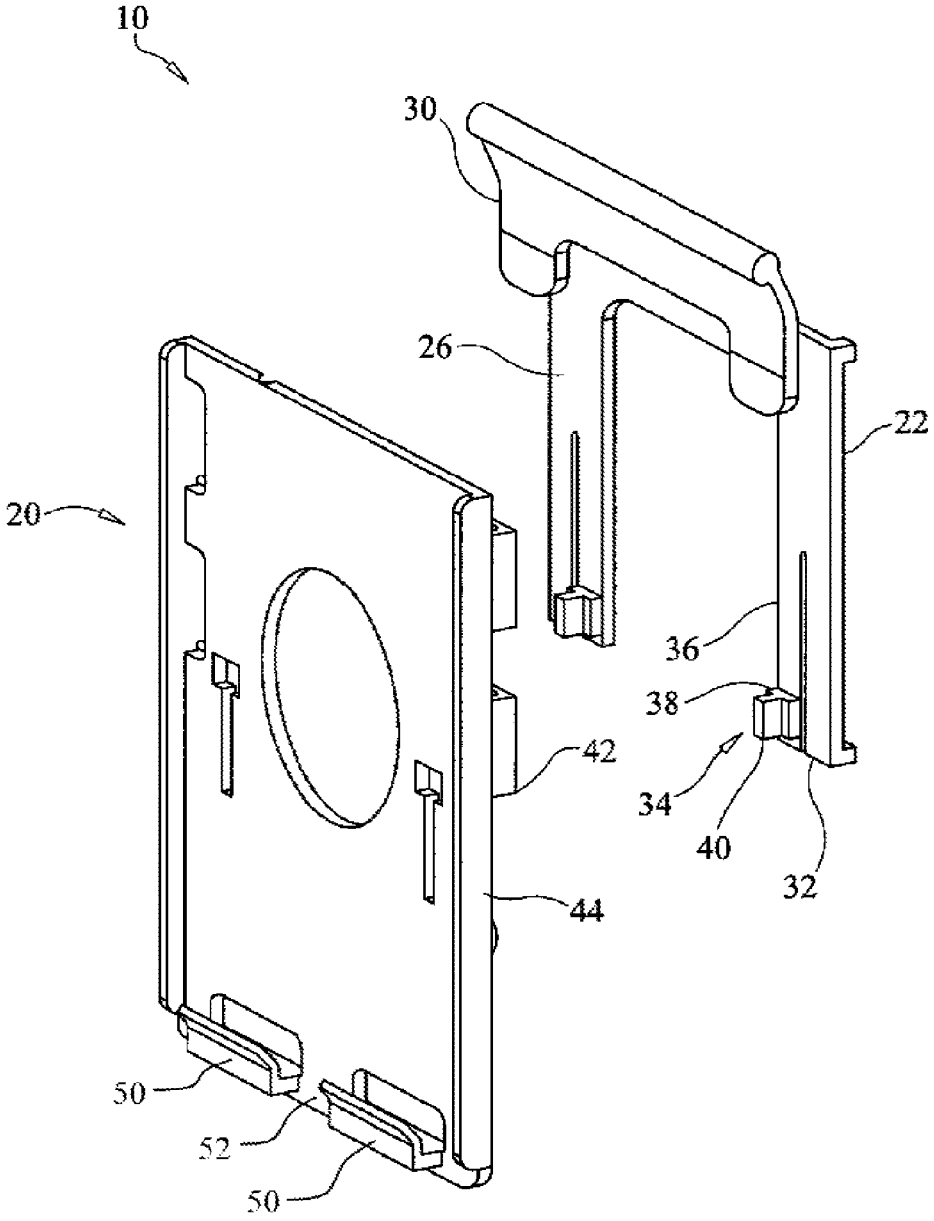
FIG. 2 is an illustration of an exploded view of an apparatus in accordance with the present invention.
Figure 3:
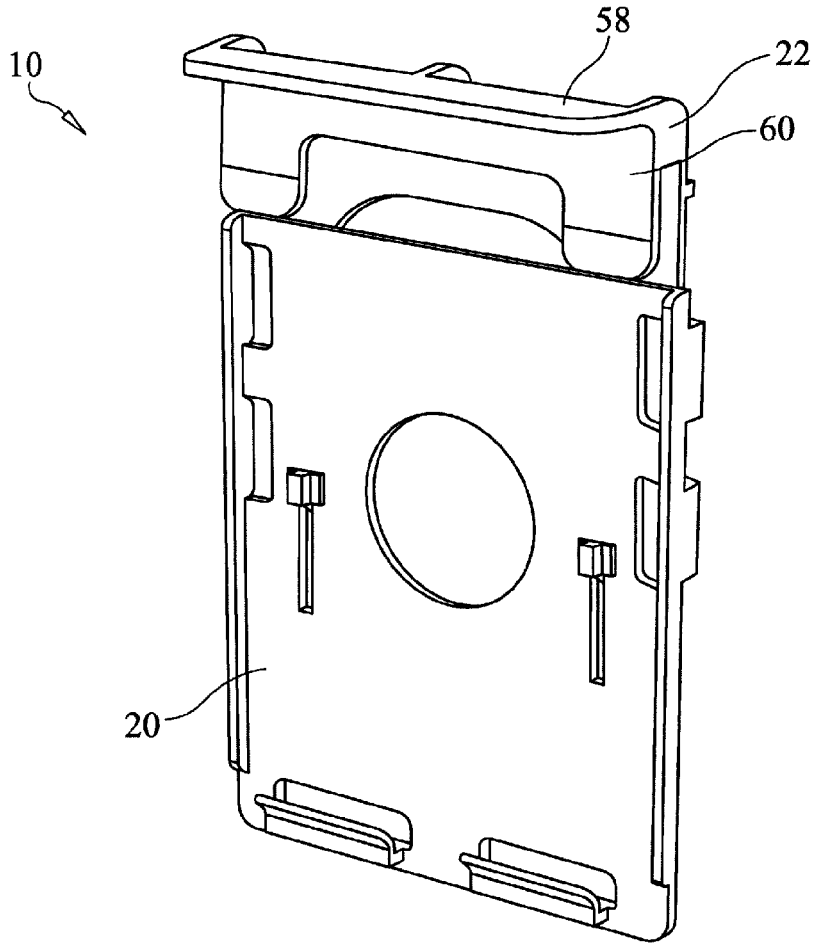
FIG. 3 is an illustration of a front perspective view of an embodiment of an apparatus in accordance with the present invention with the locking mechanism in the disengaged position.
Figure 4:
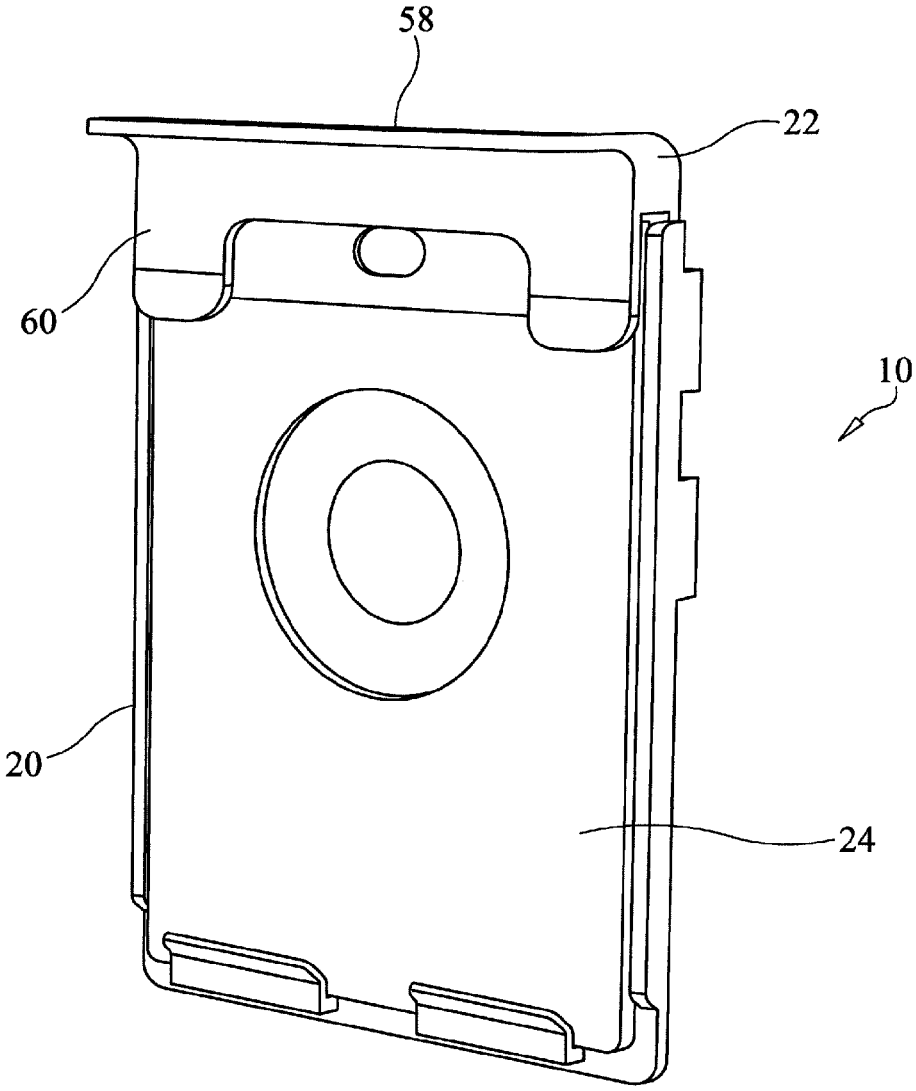
FIG. 4 is an illustration of a perspective view of an embodiment of an apparatus in accordance with the present invention and a seated filter bag collar with the locking mechanism in the engaged position.

FIGS. 2, 3 and 4 illustrates the parts of the apparatus 10. The apparatus 10 includes a filter bag collar mount 20 and a locking mechanism 22. The filter bag collar mount 20 and the locking mechanism 22 may be made of hard plastic, metal or an equivalent material. The locking mechanism 22 is moveably connected to the filter bag collar mount 20, so that the locking mechanism 22 is able to be in a disengaged position (FIG. 3) or in an engaged position (FIG. 4) relative to the filter bag collar mount 20. As shown in FIG. 4, the locking mechanism 22 may be put in the engaged position only with the proper placement of a filter bag collar 24 in the filter bag collar mount 20.

Figure 5:
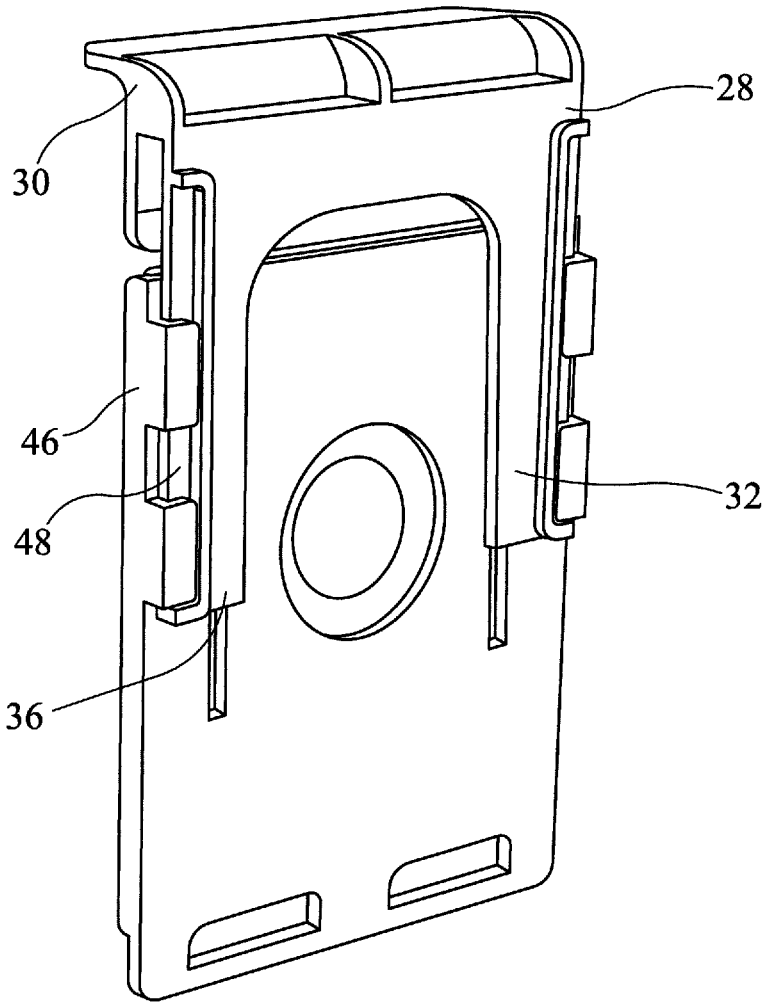
FIG. 5 is an illustration of a rear perspective view of an embodiment of an apparatus in accordance with the present invention with the locking mechanism in the disengaged position.

As shown in FIGS. 2 and 5, the locking mechanism 22 has a front side 26, a back side 28, a top side 30, and a bottom side 32, and may be generally U-shaped. The front side 26 of the locking mechanism 22 includes one or more protrusions 34. The one or more protrusions 34 is depressible toward the back side 28 of the locking mechanism 22. As shown in FIG. 2, a protrusion 34 may be located on an arm 36 of the locking mechanism, which is flexible enough to allow the protrusion to be depressed toward the back side of the locking mechanism.

In one embodiment of the apparatus, each protrusion 34 includes a first projection 38 and a second projection 40. The filter bag collar mount 20 has a slot 42 and channel 44. The slot 42 is of a width and shape which corresponds with the first projection 38, and the channel 44 is of a width and shape which corresponds with the second projection 40. Thus, the protrusion 34, when depressed, fits the channel 44 of the filter bag collar mount in a moveable lockable connection within the channel 44. As shown, the first projection width is greater than the channel width, and wherein a width of the second projection width is less than or equal to the channel width. However, alternative equivalent geometries are also contemplated.

In addition, the filter bag collar mount 20 may have grooves 46 for corresponding holding elements 48 in the locking mechanism, or vice versa, so that the locking mechanism 22 and the filter bag collar mount 20 may remain in moveable engagement when the protuberance is depressed. Alternative equivalent means for moveable engagement are also contemplated.

In addition, as shown in FIG. 2, the filter bag collar mount 20 may include one or more pivot elements 50 which may be located on the bottom side 52 of the filter bag collar mount 20. The pivot elements 50 help guide a filter bag into correct orientation on the filter bag collar mount 20. In an alternative embodiment, the filter bag collar mount 20 may include one or more slits, and the bottom side of the locking mechanism 22 may include pivot elements such that the pivot elements 50 are placed in the slits and extend through them.

In addition, the locking mechanism 22 may include a handling tab 58 on the top end 30 for operation by a user. The locking mechanism 22 also includes one or more locking flanges 60 for securing a filter bag collar to the filter bag collar mount 20. As shown, the locking flange 60 may overhang the front side 26 of the locking mechanism 22.

Figure 6:
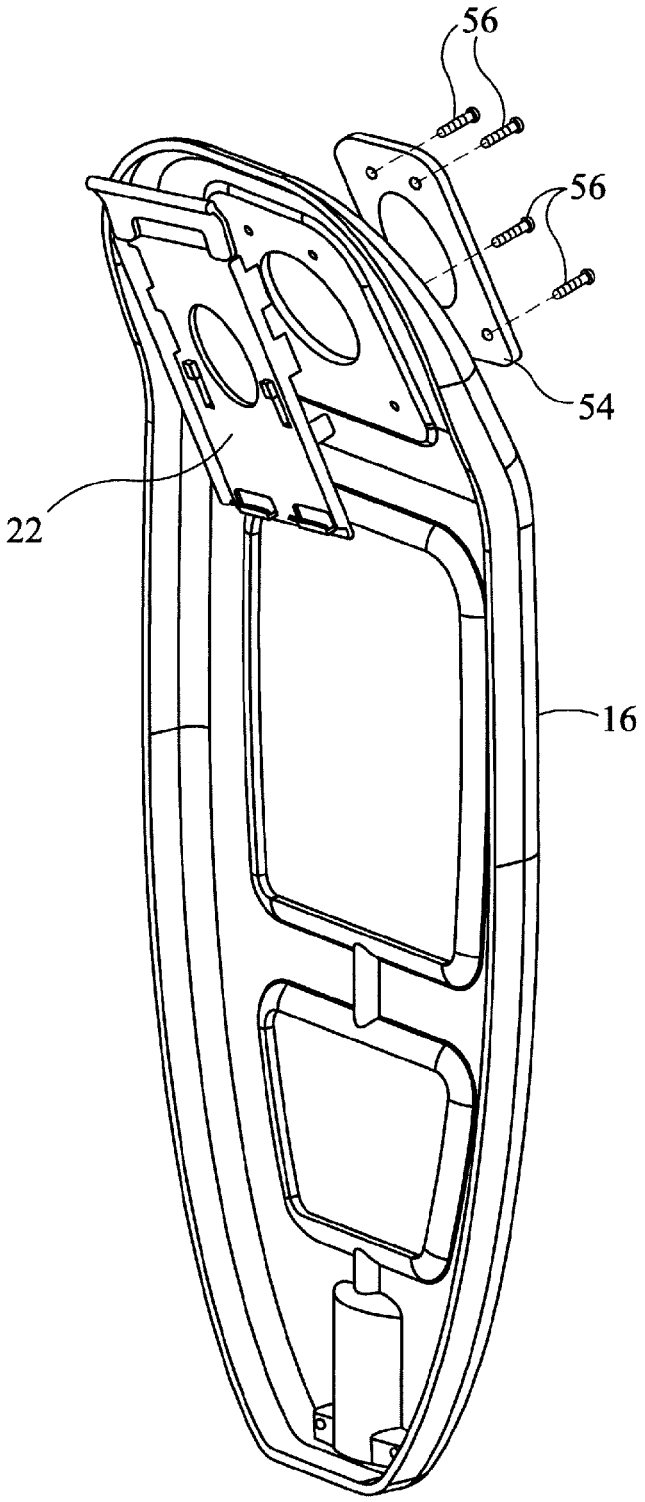
FIG. 6 is an illustration of a perspective exploded view of a detail of an embodiment of a vacuum cleaner in accordance with the present invention.

FIG. 6 illustrates another embodiment of the invention. As shown, a mounting plate 54 is secured to an outer surface of the outer shell 16 for mounting the filter bag collar mount 20 to an inner surface of the outer shell. The mounting plate is attached to the filter bag collar mount 20 by securing means such as screws 56.

The operation of one embodiment of the invention is as follows. The locking apparatus mechanism is installed on a vacuum cleaner and the locking mechanism is placed in the disengaged position. In the disengaged position, the top portion of the locking mechanism extends outside of the outer shell. Thus, the outer shell cannot be closed, and the user is able to see from a distance that there is no filter bag installed in the vacuum cleaner. The user then places a filter bag in the vacuum cleaner. The filter bag collar is placed on the filter bag collar mount. The filter bag collar may be guided by pivot points in the filter bag collar. Once placed on the filter bag collar mount, the filter bag collar depresses protrusions on the locking mechanism. The geometry of the locking mechanism and the filter bag collar mount allow the protuberance to recede into the slot in the filter bag collar mount and slide down a channel in the filter bag collar mount. Thus, the locking mechanism may slide from the disengaged position to the engaged position. Once in the engaged position, the top portion of the locking mechanism no longer extends outside of the outer shell, and the outer shell may be closed to enclose the filter bag.

In yet another embodiment, this invention may include a threaded connection between the filter bag and the vacuum cleaner pursuant to U.S. patent application Ser. No. 12/628,840, which is incorporated be reference herein.

It will be appreciated by persons skilled in the art that the present invention is not limited to what has been particularly shown and described hereinabove. In addition, unless mention was made to the contrary, it should be noted that all of the accompanying drawings are not to scale. A variety of modifications and variations are possible in light of the above teachings without departing from the scope and spirit of the invention, which is limited only by the following claims.

What is claimed is:

1. A filter bag indicator and lock-out safety apparatus for a vacuum cleaner having a closeable shell for a filter bag, comprising:

a filter bag collar mount; and a locking mechanism movably connected to the filter bag collar mount having a front side, a back side, a top side, and a bottom side, wherein the front side includes one or more protrusions depressible toward the back side, wherein the locking mechanism is able to be in one of an engaged position or a disengaged position relative to the filter bag collar mount, and wherein the locking mechanism in the disengaged position protrudes from the closeable shell and prevents the closeable shell from closing.

2. A filter bag indicator and lock-out safety apparatus for a vacuum cleaner having a closeable shell for a filter bag, comprising:

a filter bag collar mount; and a locking mechanism movably connected to the filter bag collar mount having a front side, a back side, a top side, and a bottom side, wherein the front side includes one or more protrusions having a first projection with a first width, and a second projection with a second width, wherein the locking mechanism is able to be in one of an engaged position or a disengaged position relative to the filter bag collar mount;

wherein the locking mechanism in the disengaged position protrudes from the closeable shell and prevents the closeable shell from closing.

3. The apparatus of claim 1, wherein one of the one or more protrusions depresses upon flush contact of the filter bag collar mount with a filter bag collar.

4. The apparatus of claim 2, wherein the filter bag collar mount comprises one or more slots having a width complementary to the one or more protrusions, and one of the one or more slots includes a channel having a width whereby a respective protrusion may fit the channel in a slidable connection with the filter bag collar mount.

5. The apparatus of claim 2, wherein the filter bag collar mount comprises one or more slots having a width complementary to the one or more protrusions, and one of the one or more slot includes a channel wherein a width of the first projection is greater than the slot width, and wherein a width of the second projection is less than or equal to the channel width.

6. The apparatus of claim 5, further comprising a mounting plate located on an outer surface of the outer shell, whereby the filter bag collar mount is secured to an inner surface of the outer shell.

7. The apparatus of claim 1, wherein the filter bag collar mount includes a top side and a bottom side, and the collar mount bottom side includes one or more pivot elements.

8. The apparatus of claim 1, wherein the filter bag collar mount includes one or more slits, and wherein the bottom side of the locking mechanism includes one or more pivot elements, wherein the one or more pivot elements fit within respective slits.

9. The apparatus of claim 1, wherein the locking mechanism is generally U-shaped.

10. The apparatus of claim 1, wherein the front side of the locking mechanism includes one or more locking flanges.

11. The apparatus of claim 10, wherein the locking flange overhangs the front side of the locking mechanism.

12. A filter bag indicator and lock-out safety system for a vacuum cleaner having a closeable shell for a filter bag, comprising:

a filter bag collar mount;

a generally U-shaped locking mechanism movably connected to the filter bag collar mount; and a filter bag, wherein the locking mechanism is able to be in one of an engaged position or in a disengaged position relative to the filter bag collar mount, wherein the locking mechanism is able to be in the engaged position when the filter bag is properly in the filter bag collar mount, and wherein the locking mechanism is not able to be in the engaged position when the filter bag is not properly in the filter bag collar mount.

13. The lock-out safety system of claim 12, wherein a portion of the locking mechanism in the disengaged position lies outside of the closeable shell.

14. The lock-out safety system of claim 12, wherein the filter bag collar mount includes pivot elements.

15. A lock-out safety apparatus for a vacuum cleaner having a closeable shell for a filter bag, comprising:

a filter bag collar mount; and a locking mechanism movably connected to the filter bag collar mount, wherein the locking mechanism is able to be in one of an engaged position or in a disengaged position relative to the filter bag collar mount;

wherein the locking mechanism in the disengaged position prevents the closeable shell from closing, wherein the locking mechanism comprises:

a front side, a back side, a top side, and a bottom side, wherein the front side includes one or more protrusions, each protrusion having a first projection with a first width, and a second projection with a second width, wherein the filter bag collar mount comprises one or more slots each including a channel, wherein the first projection width is greater than the channel width, and wherein the second projection width is less than or equal to the channel width.

16. The lock-out safety apparatus of claim 15, further comprising a mounting plate secured to an outer surface of the outer shell, whereby the filter bag collar mount is secured to an inner surface of the outer shell.

17. The lock-out safety apparatus of claim 15, wherein the filter bag collar mount includes a top side and a bottom side, and the bottom side includes one or more pivot elements.

18. The lock-out safety apparatus of claim 15, wherein the locking mechanism is generally U-shaped.

19. The lock-out safety apparatus of claim 15, wherein the front side of the locking mechanism includes one or more filter bag locking flanges.

20. A method of indicating the presence of a filter bag in a vacuum cleaner, comprising the steps of:

providing a filter bag collar mount; and providing a locking mechanism movably connected to the filter bag collar mount having a back side and a front side including one or more protrusions depressible toward the back side, wherein the locking mechanism is able to be in one of an engaged position or in a disengaged position relative to the filter bag collar mount;

wherein the locking mechanism in the disengaged position protrudes from a closeable shell and prevents the closeable shell from closing.

* * * * *